US007887059B2

(12) United States Patent
Kiernan

(10) Patent No.: US 7,887,059 B2
(45) Date of Patent: Feb. 15, 2011

(54) BAG TOSS GOLF GAME AND GAME TARGET

(76) Inventor: James Edward Kiernan, 10255 Summertin Way, Fishers, IN (US) 46037

( * ) Notice: Subject to any disclaimer, the term of this patent is extended or adjusted under 35 U.S.C. 154(b) by 36 days.

(21) Appl. No.: 12/472,874

(22) Filed: May 27, 2009

(65) Prior Publication Data

US 2009/0295093 A1 Dec. 3, 2009

Related U.S. Application Data

(60) Provisional application No. 61/056,105, filed on May 27, 2008.

(51) Int. Cl.
*A63B 63/00* (2006.01)
*A63B 63/08* (2006.01)
*A63F 67/02* (2006.01)

(52) U.S. Cl. ..... 273/317.2; 273/402; 273/407; 273/348

(58) Field of Classification Search ..... 273/348, 273/354, 359, 398, 401, 402, 407
See application file for complete search history.

(56) References Cited

U.S. PATENT DOCUMENTS

| | | | | | |
|---|---|---|---|---|---|
| 1,616,270 | A * | 2/1927 | Madden | 273/401 |
| 2,738,978 | A * | 3/1956 | Henry | 273/383 |
| 2,886,321 | A * | 5/1959 | Tarte, Jr. | 273/368 |
| 3,066,938 | A * | 12/1962 | Walz | 273/357 |
| 3,794,318 | A * | 2/1974 | Holmes | 473/446 |
| 4,726,591 | A | 2/1988 | Johnson | |
| 4,936,590 | A | 6/1990 | Palmer | |
| 5,050,889 | A | 9/1991 | Walker | |
| 5,201,527 | A | 4/1993 | Koket | |
| 5,575,483 | A | 11/1996 | Dineen et al. | |
| 5,765,832 | A | 6/1998 | Huff | |
| 5,871,216 | A * | 2/1999 | Sparacino | 273/402 |
| 6,932,345 | B1 * | 8/2005 | O'Dell | 273/402 |
| 7,611,147 | B2 * | 11/2009 | Sheldon | 273/366 |
| 2008/0042360 | A1 * | 2/2008 | Veikley | 273/398 |
| 2009/0295093 | A1 * | 12/2009 | Kiernan | 273/317.2 |

* cited by examiner

*Primary Examiner*—Raleigh W. Chiu
(74) *Attorney, Agent, or Firm*—Bruce J. Bowman

(57) ABSTRACT

A bag toss game target has an angled landing surface with a target opening that rotates on a base of the game target whereby rotation of the landing surface changes direction of the slope of the landing surface and the target opening location relative to the base. The landing surface is provided by a platform that is raised relative to the target base. The platform is temporarily fixed in rotation to define various set positions and slope directions of the landing surface relative to the target base. The configuration of the present game target provides a bag toss game and game target that emulates the game of golf wherein the platform and target opening represents a golf green and golf hole (collectively, golf green), with the target base representing at least a portion of a golf hole fairway or approach leading to the golf green. The golf green may be temporarily fixed in eighteen different rotational positions relative to the fairway to represent eighteen holes of golf, with each rotational position providing a different golf green layout (i.e. slope direction and hole placement). The target base or fairway may include one or more openings for representing water and sand traps. A manner of scoring bag toss golf is also provided.

16 Claims, 8 Drawing Sheets

BAG TOSS GOLF GAME AND GAME TARGET

RELATED APPLICATIONS

This patent application claims the benefit of and/or priority to U.S. Provisional Patent Application Ser. No. 61/056,105 filed May 27, 2008, entitled "Bean Bag Toss Game Target" the entire contents of which is specifically incorporated herein by this reference.

BACKGROUND OF THE INVENTION

1. Field of the Invention

The present invention relates to the field of toss games in general and, more particularly, to bag toss games having variable or changeable game targets.

2. Background Information

There are a myriad of tossing or pitching games that have and have not been patented in which an object or projectile such as a stone, washer, disc, bag or the like is thrown or pitched towards a target or targets. Many of these game targets are also collapsible such that they may be easily put away or stored. Some of the game targets provide one or more holes situated on a flat surface, while some of the game targets provide one or more holes situated on a slanted or sloped surface.

One such tossing or pitching game and game target is disclosed in U.S. Pat. No. 4,936,590 issued to Palmer on Jun. 26, 1990. Palmer uses two multi-apertured rectangular platforms as game targets and player positioning devices for playing the game. The platforms provide a flat target surface. For play, the platforms are situated at a distance from each other. A player stands on one of the platforms and tosses a disc towards the other platform in an attempt to drop the disc into one of the apertures. The platforms include storage compartments for the discs and can be connected to one another for easy carrying. Palmer, however, provides a tossing game wherein the playing surface is flat and the target apertures are fixed relative to the playing surface.

Other tossing or pitching games provide a playing surface that is angled or inclined. For instance, in U.S. Pat. No. 5,050,889 issued to Walker on Sep. 24, 1991, a game board assembly is disclosed that comprises an inclined playing surface with a horizontal backboard, the inclined playing surface having a target hole therein. In U.S. Pat. No. 5,201,527 issued to Koket on Apr. 13, 1993 a tossing or pitching game is provided comprising two targets, each having an inclined playing surface with a target aperture therein. The playing surface includes a pair of foldable legs. As with Palmer, both of these tossing or pitching games provide for a target opening that is fixed relative to the target playing surface. Moreover, in Walker and Koket the target playing surface angle remains fixed as well as the direction of the angle.

While the spacing of the game targets relative to one another and/or distance that a game player is from the game target(s) provides a manner of providing variety in game play, individuals who regularly play such fixed target tossing/pitching games soon become adept at tossing the projectile into the target hole. This eliminates the challenge of the game. Moreover, since such fixed target games offer no variety, players can soon lose interest in continuing play.

In view of the above, U.S. Pat. No. 5,765,832 issued to Huff on Jun. 16, 1998 discloses a tossing game target apparatus that has changeable target openings. The Huff game target apparatus includes a slanted base unit with a single opening. A rotatable disc is disposed on the slanted base and includes three different sized openings. The disc can be rotated such that any one of the three different sized openings register with the base opening. This allows variation in the target openings. However, since the Huff disc is flat, the game target still provides the same game target playing surface angle as well as direction of the angle.

It is thus apparent from the above that there is a need for a tossing/pitching game target that provides for greater variability in presentation of the target opening to the player.

It is thus further apparent from the above that there is a need for a tossing/pitching game target that provides for variation in target opening position and/or direction of slope.

SUMMARY OF THE INVENTION

The present invention provides a bag toss game target having an angled landing surface with a target opening whose direction of slope is changeable. The target opening is situated off-center on the angled landing surface such that the position of the target opening is changeable with the change in slope direction.

The angled landing surface is provided on a target base wherein rotation of the angled landing surface provides the change in slope direction as well as hole position relative to the target base.

The configuration of the present game target provides a bag toss game and game target that emulates a game of golf wherein the landing surface and target opening represents a golf green and golf hole (collectively, golf green), with the target base on which the golf green is situated representing at least a portion of a golf hole fairway or approach leading to the golf green.

In one form, the golf green is defined by a platform that is raised relative to the target base/fairway. The golf green is temporarily fixed in rotation to define various set positions, slope directions of the landing surface, and golf hole position relative to the fairway. The golf green may be temporarily fixed in eighteen different rotational positions relative to the fairway to represent the eighteen holes of golf, with each rotational position providing a different golf green layout (i.e. slope direction and hole placement/position).

The target base or fairway may include one or more cutouts or openings that represent water and/or sand traps.

A manner of playing and scoring bag toss golf is also provided.

The various areas of the game target may be provided with different colors to help determine scoring.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Like reference numerals indicate the same or similar parts throughout the several figures.

A detailed description of the features, functions and/or configuration of the components depicted in the various figures will now be presented. It should be appreciated, however, that not all of the features of the components of the figures may be necessarily described in detail. Some of these non discussed features as well as discussed features are inherent from the figures. Other non discussed features may be inherent in component geometry and/or configuration.

DESCRIPTION OF THE PREFERRED EMBODIMENT

Figure 1:
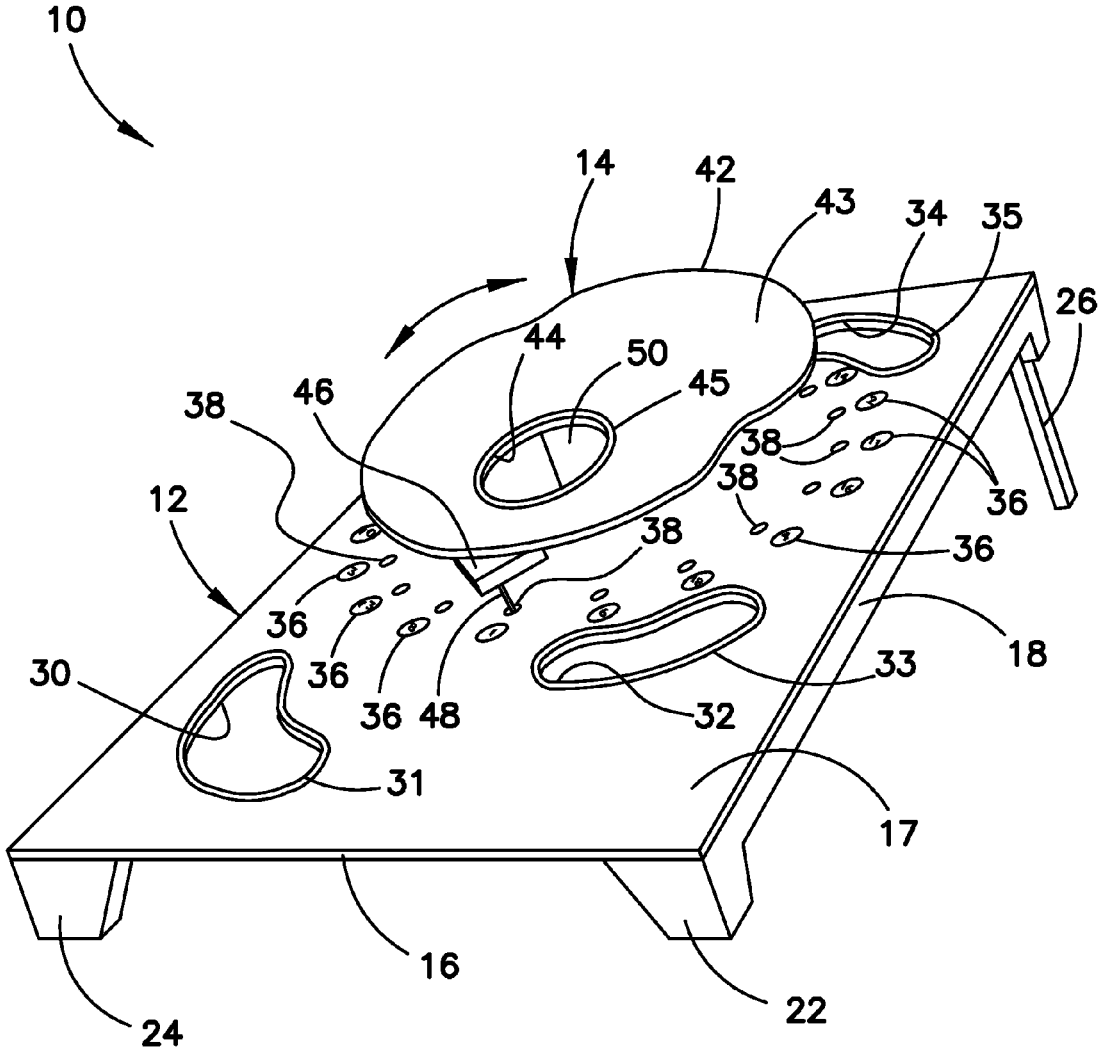
FIG. 1 is a right side perspective view of a bag toss game target having a raised and positionable platform and target opening that provides variation in playing surface slope (angle) and opening placement relative to a base of the game target, the bag toss game target particularly fashioned so as to emulate the game of golf.
Figure 2:
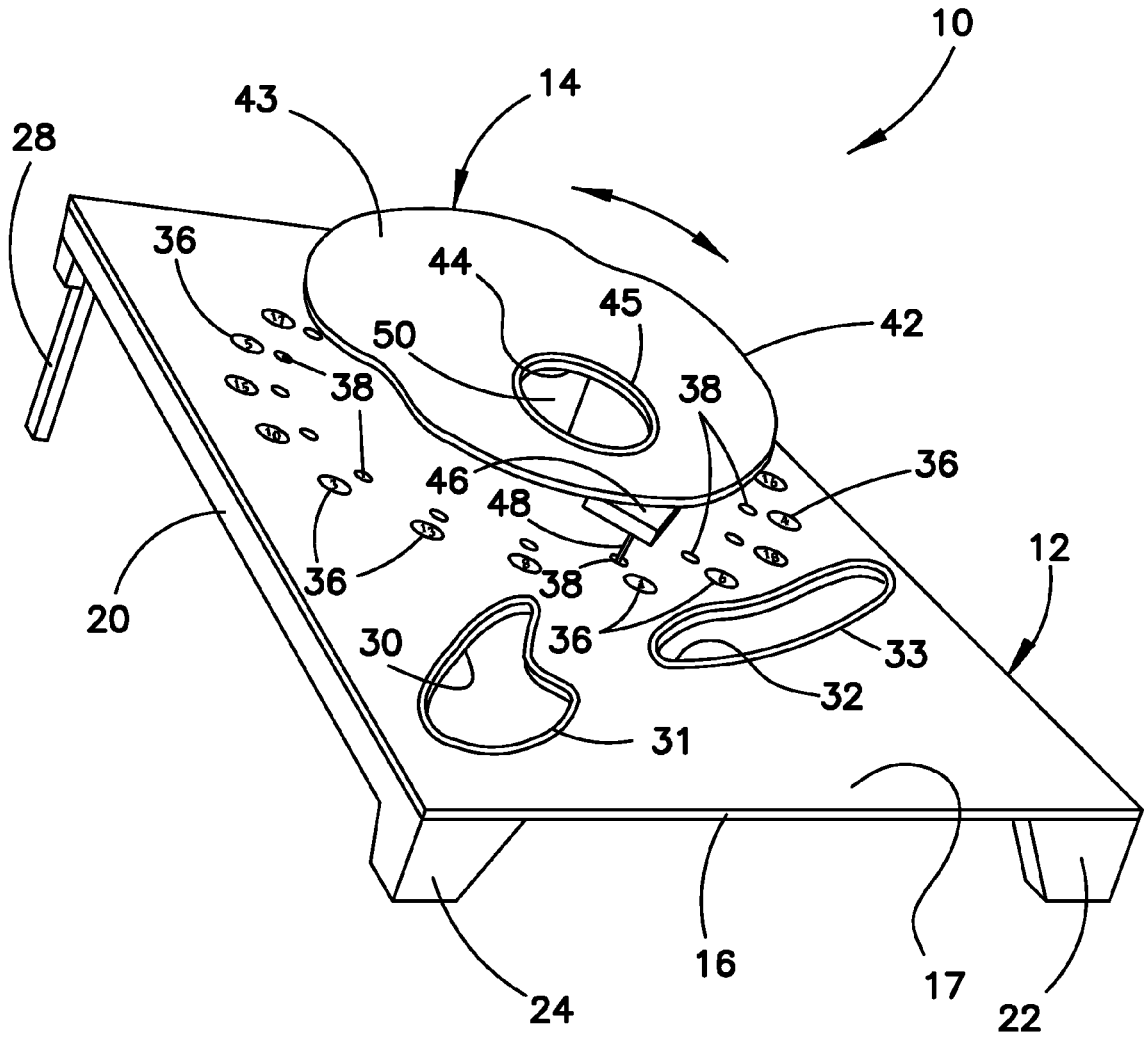
FIG. 2 is a left side perspective view of the golf-themed bag toss target of FIG. 1.

Referring to FIGS. 1 and 2, there is depicted a bag toss game target generally designated 10. The bag toss game target 10 is for use with a bag tossing or pitching game, with various manner of play provided below. However, it should be appreciated that while the present bag toss game target 10 may be configured to emulate any type of game, the present bag toss game target 10 is configured to emulate the game of golf and will hereinafter be described as such. Therefore, bag toss game target 10 may be considered a bag toss golf game target or golf-themed bag toss game target. It should be appreciated though that the principles of the present invention may be applied to bag toss game targets having or emulating other game themes, as well as bag toss game targets having no particular game theme.

The bag toss game target 10 is characterized by a base 12 and a platform 14 that is situated on the base 12. The base 12 is defined by a generally planar board 16 supported by a first side frame 18 and a second side frame 20. In one form, the board 16 is approximately 29×44 inches, but other dimensions may be used. A first front leg 22 extends from a front end of the first side frame 18 while a second front leg 24 extends from a front end of the second side frame 20 such that the first and second front legs 22, 24 form a front pair of legs. The front pair of legs 22, 24 are preferably, but not necessarily, fixed in height such that the front end of the board 16 is at a set height. A first rear leg 26 extends from a rear end of the first side frame 18 while a second rear leg 28 extends from a rear end of the second side frame 20 such that the first and second rear legs 26, 28 form a rear pair of legs. The first rear leg 26 is pivotally connected to the rear of the first side frame 18 to allow the first rear leg 26 to fold up adjacent to the first side frame 18. The second rear leg 28 is likewise pivotally connected to the rear of the second side frame 20 to allow the second rear leg 28 to fold up adjacent to the second side frame 20. It should be appreciated that the first and second rear legs 26, 28 may be fixed if desired, however, pivotal connection allows for easier storing of the base 12.

The first and second rear legs 26, 28, when extended or unfolded, support the rear of the board 16 at a height that is greater that the height of the front of the board 16. This angles the board 16 to provide an inclined playing surface 17 with the rear of the board 16 higher than the front of the board 16 (see, e.g. FIGS. 3 and 4). The first and second rear legs 26, 28 also angle slightly backward to provide better stability to the base 12. In one form, the front legs 22, 24 elevate the board 16 four inches (4") off the ground while the rear legs 26, 28 elevate the board 16 thirteen inches (13") off the ground, but other dimensions may be used. The board 16 may be considered a golf fairway or fairway portion (approach) and thus may be colored primarily green.

Figure 5:
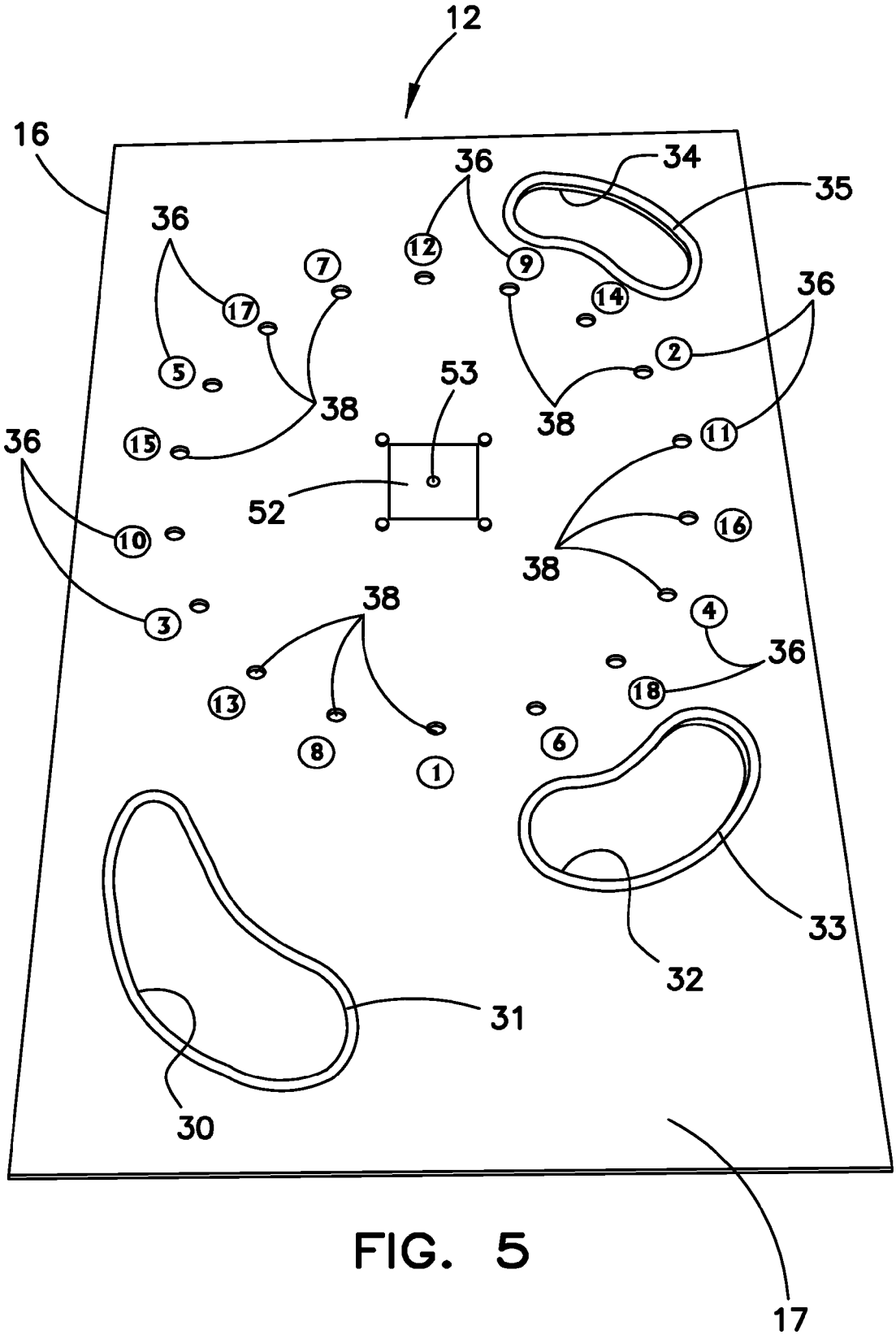
FIG. 5 is a top plan view of the golf-themed bag toss target of FIG. 1 with the golf green and golf hole portion thereof removed.

The base 12 includes a number of cutouts or shaped openings 30, 32 and 34, that are disposed about the platform 14. More or less cutouts may be provided as desired. A cutout represents a sand trap or water hazard, with a cutout being arbitrarily either one. As best seen in FIG. 5, the three cutouts 30, 32 and 34 are generally kidney-shaped but other shapes may be used. Each cutout includes an outline that indicates by color whether the cutout is a water hazard or a sand trap. Cutout 30 thus includes an outline 31, cutout 32 includes an outline 33, and cutout 34 includes an outline 35. In this embodiment, outline 31 is colored blue to signify or represent that cutout 30 is a water hazard, outline 33 is colored beige to signify or represent that cutout 32 is a sand trap, while outline 35 is likewise colored beige to signify or represent that cutout 34 is also a sand trap. The water hazard 30 may be approximately twelve inches (12") in length while the sand traps 32, 34 may be approximately nine inches (9") in length. Again, the placement, number, size and type of cutout are arbitrary. As described below, scoring is different with respect to whether the cutout is a water hazard or a sand trap.

Still referring to FIG. 5, the base 12 includes a rotation surface 52 that is configured to receive a stand 50 of the platform 12 and allow smooth rotation thereof. The surface 50 may thus be a suitable plastic or the like. A bore 53 is provided in the rotation surface 52 for reception of a connection post or shaft 58 (see FIG. 6) such that the platform 14 is rotatably received in the board 16. The board 16 further includes a plurality of bores or holes 38 that radially surround the rotation surface/bore 52, 53 (of which only some of the bores 38 have been numbered). The bores 38 provide and define rotational positions of or stops for the platform 12 relative to the base 12. Each bore 38 has corresponding numbering 36 adjacent thereto to label each position (i.e. indexing for the rotational position of the platform 12). Since the game target 10 is golf-themed, there are eighteen (18) bores 38 each one labeled with one of the numbers one (1) through eighteen (18) to represent the eighteen holes in golf (i.e. the hole number). Of course, more or less bores 38 may be provided as desired. Also, note that the bores are not consecutively labeled with hole numbers, but are in a random order to provide the feel of a real golf course.

Referring back to FIGS. 1 and 2, the platform 14 may be considered a primary target or playing surface and is rotatable relative to the base 12 as represented by the double-headed arrow. The platform 14 includes a board 42 defining a playing surface 43 with an opening, aperture or hole 44 therein. The board 42 may be approximately twenty-two inches (22") in diameter, but may be sized accordingly. The board 42 is preferably, but not necessarily, irregularly shaped so as to simulate or represent a golf green. As such, the platform 14 is colored a green that is lighter in shade than the green of the base 12. The golf hole or game target 44 includes an outline 45 that is colored white to signify or represent a golf hole. The platform 14 further includes a pointer 46 that extends from a bottom of the board 42 and which is configured to point to the hole number 38 to which the platform 14 is rotationally set. A flexible indexer or platform rotation temporary fixing mechanism or stick 48 is provided at the end of the pointer 46 for temporarily fixing the rotation of the platform 14 by extending into one of the holes 38. Being flexible, the indexer 48 easily bends when the platform 14 is rotated, but flexes back into a straight shape when encountering a hole 38. In this manner, the rotational position of the golf green is easily changed to effect a change in golf hole number. It should be appreciated that other mechanisms for changing and/or fixing the rotational position of the platform may be used and are contemplated such as, for example, a spring-loaded peg or the like that is configured to allow the user to lift is up out of a hole 38 to rotate the platform, then provides a bias to project the peg into the desired hole 38/platform rotation position.

The golf green/board 42 is also angled in one direction relative to the base 12 whereby rotation thereof changes the direction of slope of the golf green 42 relative to the base 12. Since the golf hole 44 is off-center on the golf green 42, rotation of the golf green 42 also changes the position or location of the golf hole 44 relative to the base 12, the water hazard 30 and the sand traps 32, 34. This changes the characteristics of the game target and thus creates a different golf green for each of the eighteen (18) golf holes.

Figure 3:
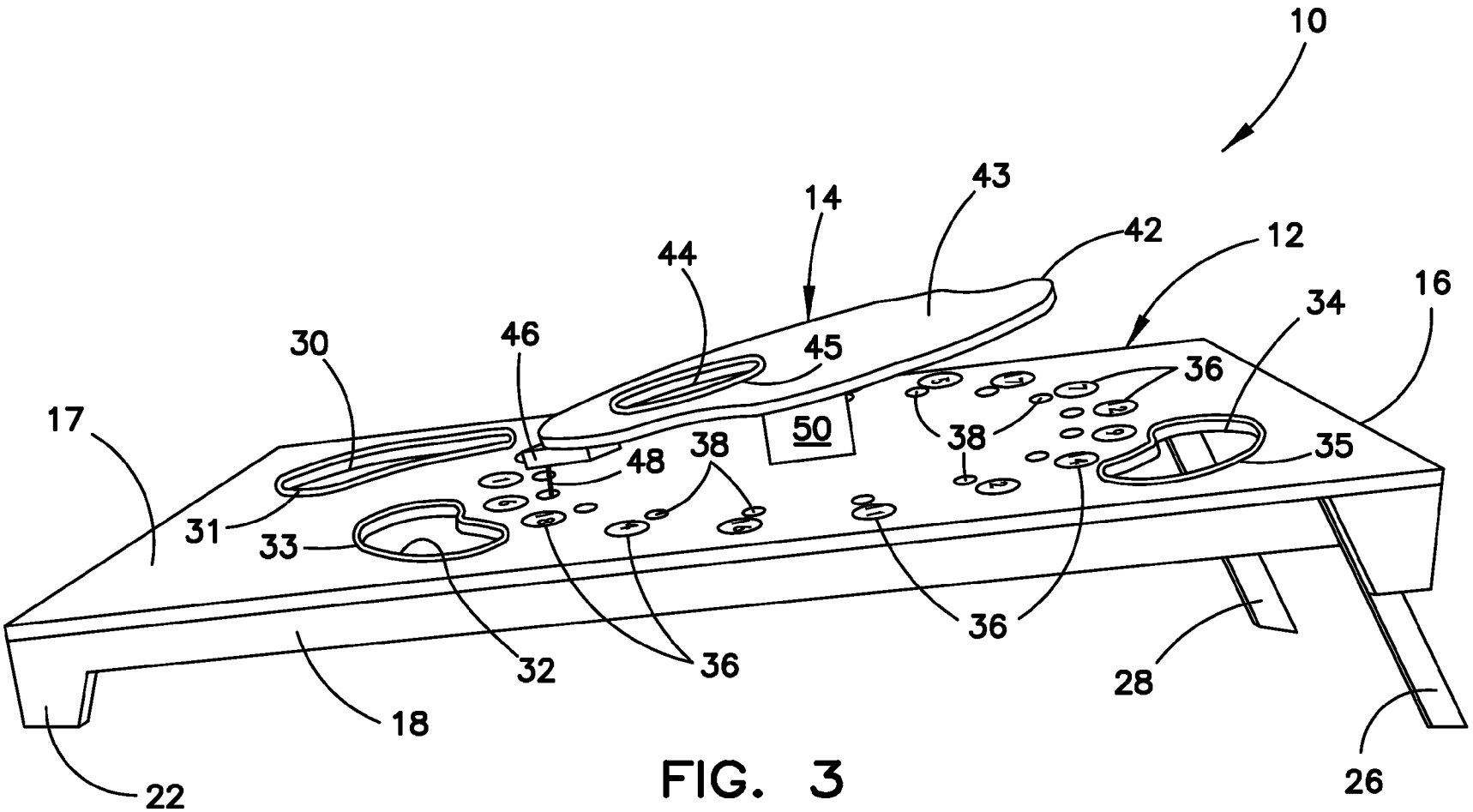
FIG. 3 is a right side view of the golf-themed bag toss target of FIG. 1 with the golf green (platform) and golf hole (opening) thereof set to a $1^{st}$ hole position.
Figure 4:
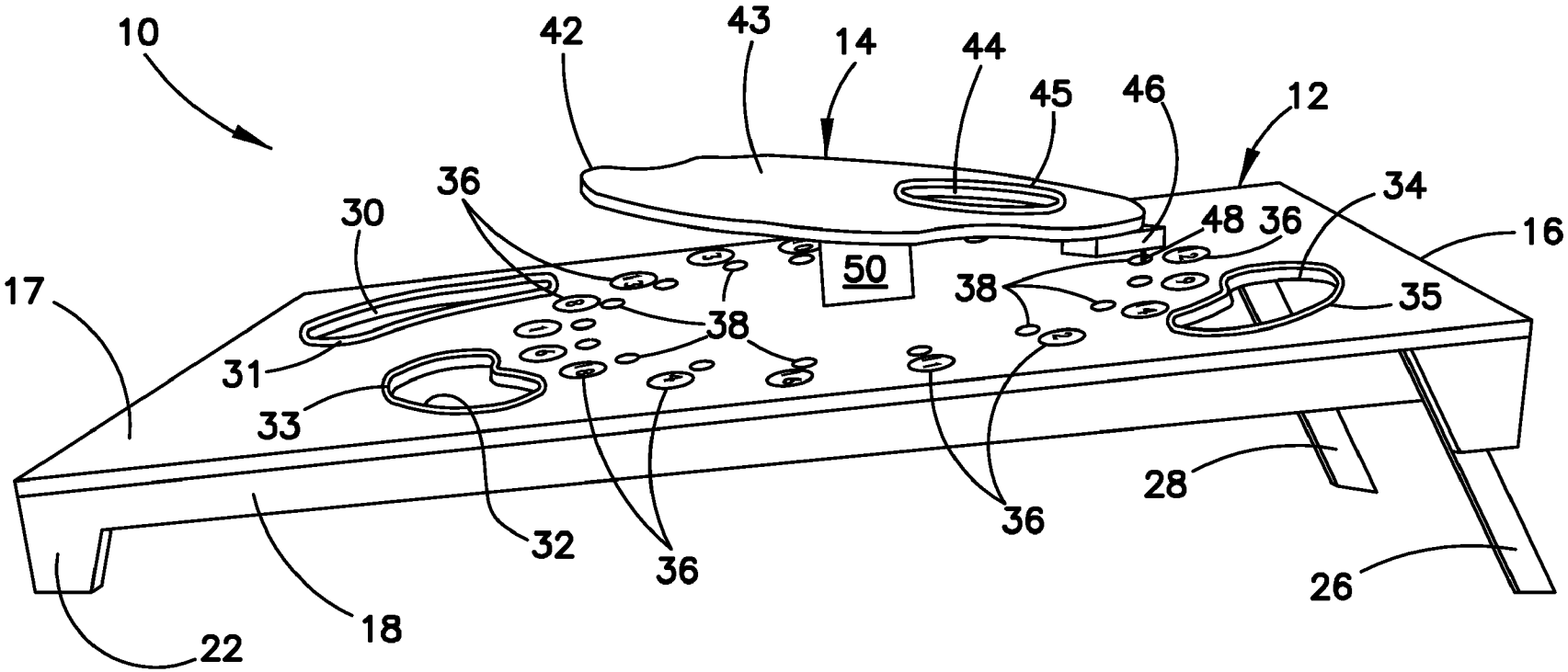
FIG. 4 is right side view of the golf-themed bag toss target of FIG. 1 with the golf green and golf hole portion thereof in a $12^{th}$ hole position.

FIG. 3 shows the golf green 42 in a golf hole #6 position wherein the direction of slope of the playing surface 43 angles downwardly towards the player. The golf hole 44 is positioned towards the player and the front of the green. Therefore, along with the slant or tilt of the base 12, golf hole #6 provides a steep downward slope towards the player. FIG. 4 shows the golf green 42 in a golf hole #12 position wherein the direction of slope of the playing surface 43 angles downwardly away from the player. The golf hole 44 is positioned away from the player and towards the back of the green. The other golf holes provide slopes in different directions relative to the base 12 and the player as well as golf hole position relative to the base 12 and the player. Thus each position has a different degree of difficulty and impacts scoring. In one form, the high side of the golf green is approximately six to seven inches (6"-7") above the base while the low side of the golf green is approximately three to four inches (3"-4") above the base. Again, these dimensions may change.

Figure 6:
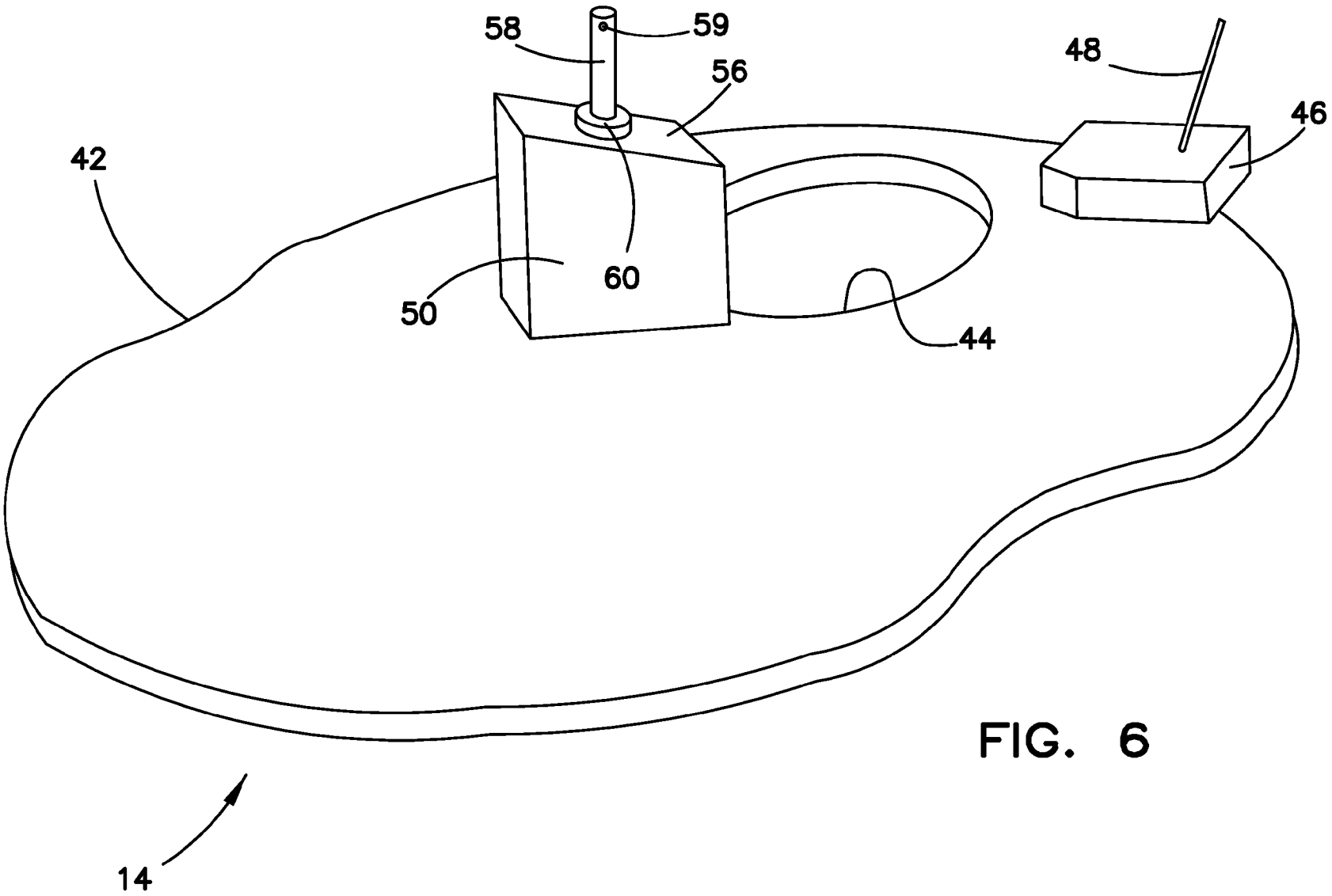
FIG. 6 is an enlarged perspective view of the underside of the golf green and golf hole portion removed from the main target body of the present golf-themed bag toss target of FIG. 1.

Referring to FIG. 6 the underside of the platform 14 is shown. The platform 14 includes a stand 50 having an angled end surface 56 relative to the board 42. A shaft 58 extends from a rotation member 60 and the stand 50 both of which are sized for reception in the bore 53. The shaft 58 thus rotationally connects the platform 14 to the base 14. The shaft may include a transverse bore 59 for receipt of a pin or the like to fix the platform to the base. Other anchoring mechanisms may be used if at all. The angled surface 56 thus rests upon the upper surface 17 of the base board 16 and determines the slope. Rotation of the platform 14 changes the direction of the angled surface 56 and thus the direction of slop of the golf green.

It should be appreciated that while the angle or slope of the board 42 (golf green) is shown as being fixed it is contemplated that the angle or slope of the golf green may be made variable. The stand 50 may thus incorporate an angle adjustment mechanism such as, for example, a multi-holed bracket which accepts a fixing pin or the like. In this form, not only would the direction of slope be changeable, but the amount of slope would also be changeable.

The game target 10 may be formed of one of or a combination of natural wood, synthetic or plastic wood and/or omega signboard. Other materials may be used. Moreover, the colors, lettering and numbering are best if digitally printed or silk screened on the target but may be applied via decals, paint or the like.

Figure 7:
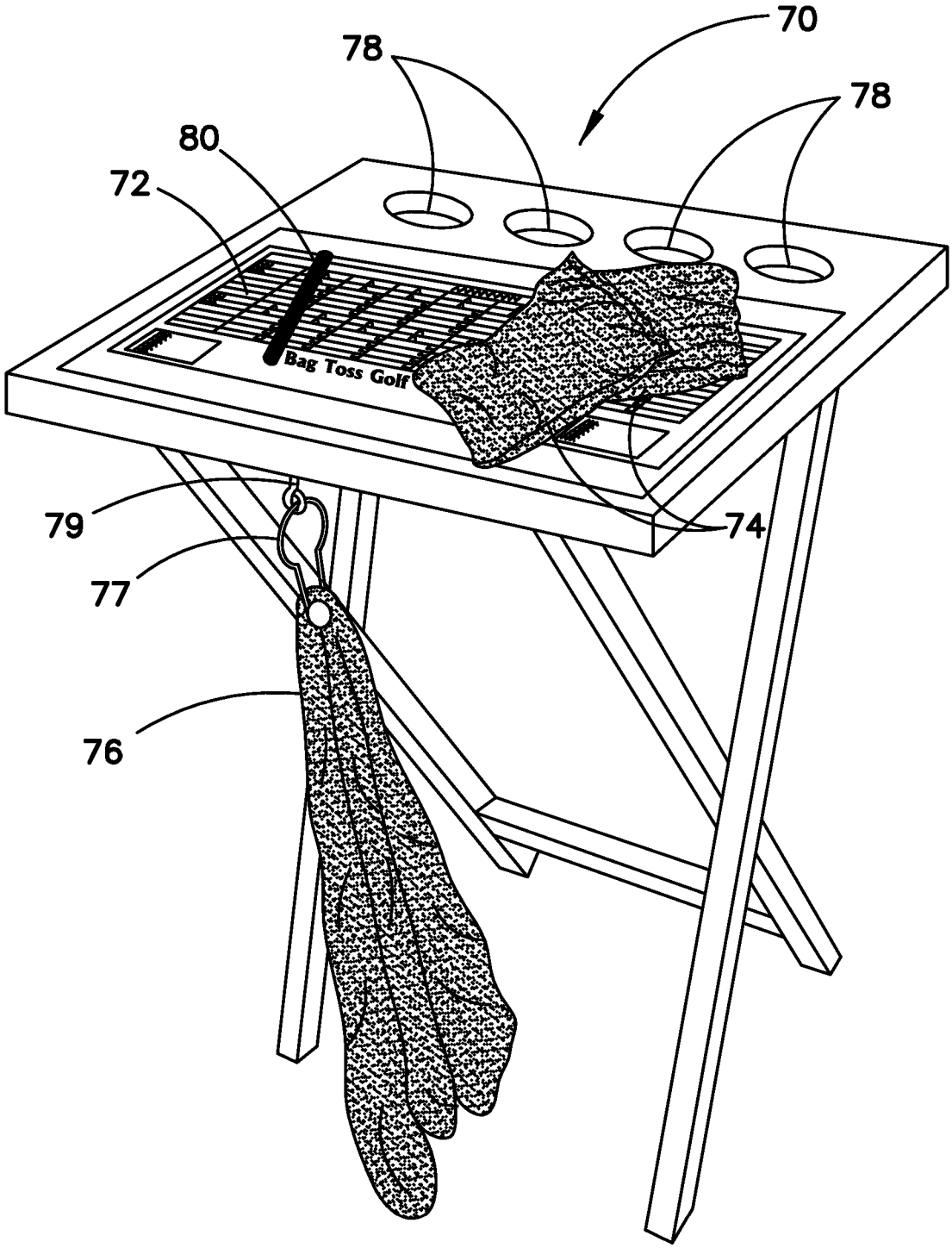
FIG. 7 is a perspective view of a scorer's table and accompanying game components for the present golf-themed bag toss game.

Referring to FIG. 7, there is depicted a scorer's table 70 where the present bag toss golf game is scored and tracked. Shown on the scorer's table 70 are two bags 74 out of up to fours bags such as are used with the game. The bags 74 are preferably, but not necessarily, about five inches (5") square. The bags 74 are also preferably, but not necessarily, filled with corn, but may be filled with beans or other organic or non-organic material. A score card 72 is also provided on the scorer's table 70 for recording (tracking and scoring) each player's score for each hole. The score card 72 is preferably, but not necessarily, of a white-board or similar type material that allows for writing thereon and easily removal or wiping away of the writing via a dry-erase marker or writing utensil 80. The score card 72 may be laminated on the table 70, be a decal, or be provided in another manner that affixes the score card 72 thereto. The scorer's table also includes cutouts 78 for holding beverages. A golf towel 76 with a conventional towel clip 77 may be attached to the table 70 through connection to an eyelet 79. The towel may be used to wipe off the score card or allow a player to dry their hands.

Figure 8:
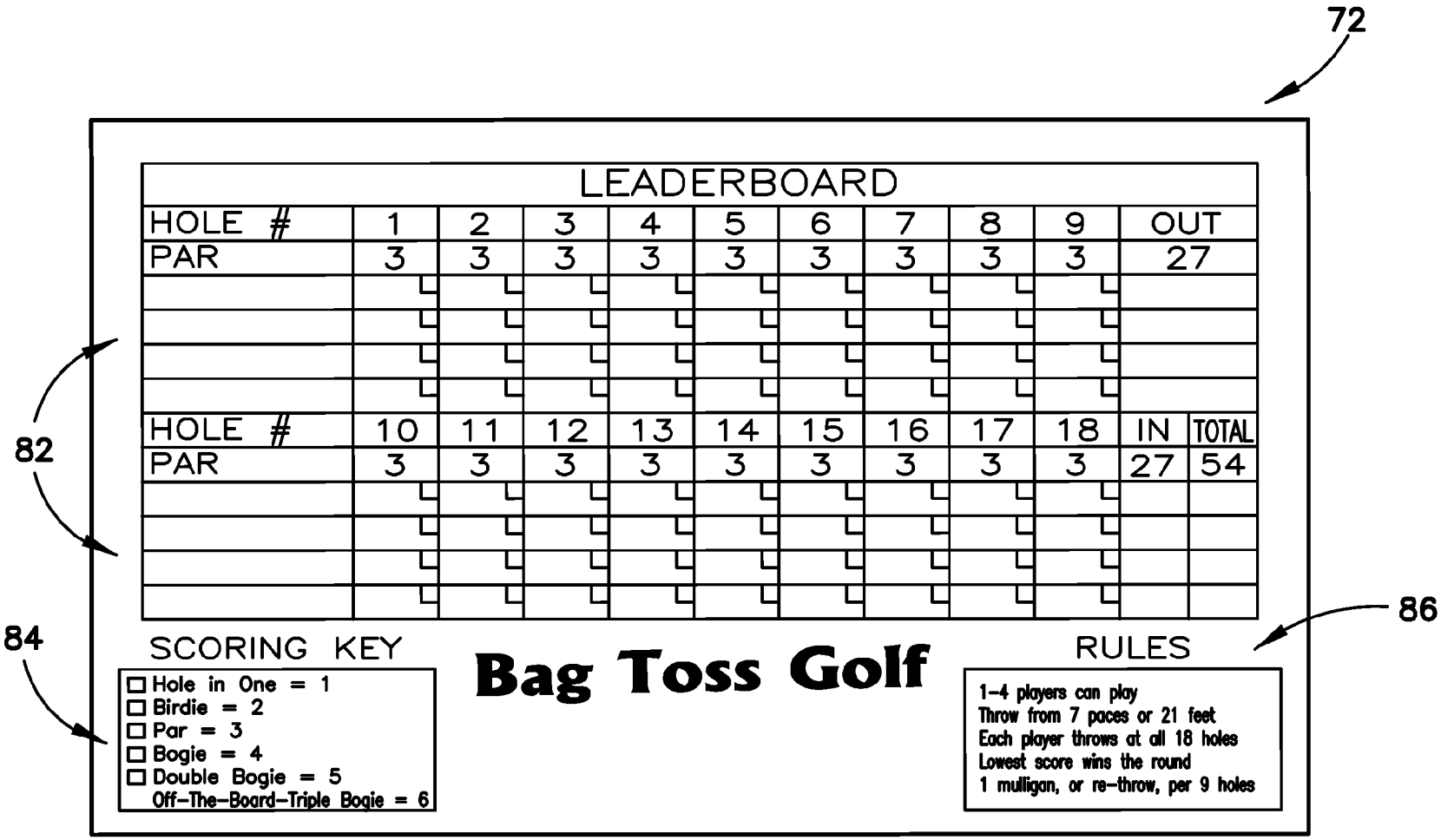
FIG. 8 is an enlarged top plan view of the score card for the present golf-themed bag toss game.

FIG. 8 shows an enlarged view of the score card 72 that is similar to a golf score card. The score card 72 includes an area 82 for tracking the score of up to four (4) players, a scoring key area 84 and a rules area 86. The score tracking area 82 includes areas for the names of the players and for recording each player's score for each hole. Additionally, an area is provided for recording the "out" score (holes 1-9), for recording the "in" score (holes 10-18) and a total score. The scoring key area 84 provides a color key (square boxes) the color of which is not displayable in FIG. 8, corresponding to the colors on the game target 10.

Play

In one form of the present bag toss golf game, one to four players can play the game with each player having their own bag 74. The bags 74 are preferably but not necessarily, all white each with a black number, 1-4 (thereby matching or simulating a golf ball) in order to differentiate one player's bag (ball) from another's. Thus each player gets a bag with a particular number. Alternatively, each bag may be of a different color and/or pattern if desired. For play, each player tosses a bag 74 at the game target 10 from a desired distance such as between twenty to twenty-one feet (20'-21') or seven (7) paces. The golf green 42 is set to position or hole #1 by rotating the platform 14 accordingly and locking same into place. Each player tosses a bag 74 towards the game target and records their score on the score card 72. Scoring is calculated in the following manner.

Each hole has a value or par of three (3). If the bag 74 does not land on the game target 10 a triple bogey or three (3) over par is scored for the hole (i.e. a six (6)). If the bag lands in a water hazard 30 (a blue ringed cutout), a double bogey or two (2) over par is scored for the hole (i.e. a five (5)). If the bag lands in a sand trap 32 or 34 (a beige ringed cutout), a bogey or one (1) over par is scored for the hole (i.e. a four (4)). If the bag lands on the fairway or base 12 (the green board 16) then an even par is scored for the hole (i.e. a three (3)). If the bag lands on the green or platform 14 (the light green board 42) then a birdie or minus one (−1) is scored for the hole (i.e. a two (2)). If the bag goes through the hole 44 a hole-in-one is scored for the hole (i.e. a one (1)). The platform 14 is then rotated into the number 2 (hole #2) position and each player tosses again. This goes on until all eighteen (18) holes/green positions are played. The player with the lowest score wins. The players may agree whether mulligans or re-throws are allowed.

A variation in scoring may be used wherein each hole or green position may be assigned a value or par of three (3), four (4) or five (5) rather than having each hole or green position having the same par value. Other variations may be used.

While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected.

What is claimed is:

1. A bag toss game target comprising:

a base;

an angled platform rotatably disposed on the base and defining a slope whereby rotation of the platform changes direction of the slope relative to the base; and a target opening disposed in the platform.

2. The bag toss game target of claim 1, wherein the base is inclined.

3. The bag toss game target of claim 2, wherein the base includes a cutout.

4. The bag toss game target of claim 1, wherein the target opening is disposed in the platform off-centered.

5. The bag toss game target of claim 1, wherein the platform is configured to be temporarily fixed in a rotational position.

6. The bag toss game target of claim 5, wherein the base includes a plurality of bores defining a like plurality of rotational positions for the angled platform, and the angled platform includes a member configured to cooperate with any one of the plurality of bores to temporarily fix the platform into any one of the plurality of rotational positions.

7. The bag toss game target of claim 6, wherein the plurality of bores equals eighteen.

8. The bag toss game target of claim 6, wherein the member comprises a flexible shaft.

9. A bag toss game target comprising:

a base;

a raised platform rotatably disposed on the base and having a playing surface that is angled relative to the base to define a slope, whereby rotation of the platform changes direction of the slope relative to the base; and a hole disposed in the playing surface.

10. The bag toss game target of claim 9, wherein the base is upwardly inclined from a front of the base to a rear of the base.

11. The bag toss game target of claim 10, wherein the base includes a plurality of cutouts.

12. The bag toss game target of claim 9, wherein the hole is disposed in an off-center position on the playing surface.

13. The bag toss game target of claim 9, wherein the raised platform is configured to be temporarily fixed in a rotational position.

14. The bag toss game target of claim 13, wherein the base includes a plurality of radially-spaced bores defining a like plurality of rotational positions for the raised platform, the raised platform configured to be temporarily fixed by the plurality of radially-spaced bores into any one of the plurality of rotational positions.

15. The bag toss game target of claim 14, wherein the plurality of radially spaced bores equals eighteen.

16. The bag toss game target of claim 14, wherein the raised platform includes a flexible shaft that cooperates with any one of the eighteen bores to temporarily fix the platform into any one of eighteen rotational positions.

* * * * *